US007244156B1

(12) United States Patent
Hazelett et al.

(10) Patent No.: US 7,244,156 B1
(45) Date of Patent: Jul. 17, 2007

(54) LIGHTWEIGHT MARINE BUOY AND METHOD OF HANDLING THE SAME

(75) Inventors: R. William Hazelett, Colchester, VT (US); Jeffrey P. Lefebvre, Colchester, VT (US)

(73) Assignee: Hazelett Strip Casting Corporation, Colchester, VT (US)

( * ) Notice: Subject to any disclaimer, the term of this patent is extended or adjusted under 35 U.S.C. 154(b) by 0 days.

(21) Appl. No.: 11/345,827

(22) Filed: Feb. 2, 2006

(51) Int. Cl.
*B63B 22/20* (2006.01)

(52) U.S. Cl. ..... 441/29

(58) Field of Classification Search ..... None
See application file for complete search history.

(56) References Cited

U.S. PATENT DOCUMENTS 3,084,354 A * 4/1963 Lunenschloss ..... 441/11
3,329,015 A * 7/1967 Bakke et al. ..... 441/28
3,464,071 A * 9/1969 Starratt ..... 441/29
3,939,510 A * 2/1976 Curd, Jr. ..... 441/28
5,273,468 A * 12/1993 Nichols ..... 441/29

OTHER PUBLICATIONS

Givens Marine Survival, Co., Inc., Advertisement for Givens Buoy Life Raft Illustration, Copyright 2002 Givens Marine Survival Co., Inc. and Omni Multimedia Productions.

* cited by examiner

*Primary Examiner*—Lars A. Olson
(74) *Attorney, Agent, or Firm*—McCormick, Paulding & Huber LLP

(57) ABSTRACT

A lightweight constructed navigation buoy, and method for handling the same, is provided with waterborne stability comparable to the conventional and much heavier navigation buoys. The desired waterborne stability is achieved using a liquid-ballasting/-venting system in which a ballasting compartment and a connection cooperate to allow a liquid ballast to be added and/or removed from the ballasting compartment. The position-accuracy of said buoy can be improved by incorporating the liquid ballasted buoy with a high-strength, flexible, elastic tether providing a scope of between 1.5-to-1 and 1-to-1 at high water.

8 Claims, 1 Drawing Sheet

LIGHTWEIGHT MARINE BUOY AND METHOD OF HANDLING THE SAME

FIELD OF THE INVENTION

The present invention relates to marine buoys as aids to navigation.

BACKGROUND OF THE INVENTION

Thousands of buoys are employed as aids to navigation, serving, among other things, to indicate channel locations, warn of hazards to navigation, and announce speed or wake restrictions. Navigation buoys are constantly exposed to harsh environmental forces and occasional collisions from watercraft. Sturdy buoy construction and design is required. Additionally, to facilitate the visibility and/or operability of many buoys it is desired that the buoys have a relatively high height above the waterline while demonstrating minimal pitching and rolling during heavy seas, thus requiring the inertia of a heavy overall weight combined with substantial buoyancy and ballasting that achieves a low center of gravity.

To satisfy these requirements, navigation buoys are usually constructed of heavy gauge steel for durability and ballasted with solid ballast at a location below the waterline. Concrete is a commonly used ballast material. Buoys designed to fulfill these requirements are thus very heavy and difficult to handle.

Because of the substantial weight of navigation buoys, buoy retrieval and deployment typically requires relatively large ships with high capacity davits and other specialized equipment (buoy tenders). Even with such equipment, handling heavy buoys can be difficult and dangerous, particularly when high winds and seas complicate retrieval and deployment operations. The capacity of buoy tenders to store buoys once onboard may also be restricted by the heavy weight of the buoys. The stability and trim of buoy tenders may be adversely impacted if too many buoys are stored on deck.

Accordingly, it can be seen that there is a need for a lightweight navigation buoy to facilitate in the buoy's transportation, launching, and retrieval when not deployed that can be altered to exhibit the stability characteristics of the much heavier-constructed conventional buoys when deployed.

SUMMARY OF THE INVENTION

In view of the foregoing, it is an object of the present invention to provide a navigation buoy with a liquid-ballasting/-venting system in which a predetermined amount of liquid ballast can be added or removed, resulting in a buoy that can be made substantially lighter and easier to handle when not deployed, but can be efficiently altered to possess the necessary weight and stability of currently designed navigation buoys when deployed.

It is a further object of the present invention to provide a buoy with a liquid-ballasting/-venting system that further increases the stability by providing one or more internal baffles to minimize any free-surface movement of said liquid ballast.

It is a further object of the present invention to provide a buoy with a square bottom plate wide enough to provide a roll-resistant surface when the buoy is stored on deck.

These and other advantages of the present invention will be better understood in light of the detailed description of a preferred embodiment.

DETAILED DESCRIPTION OF A PREFERRED EMBODIMENT

Figure 1:
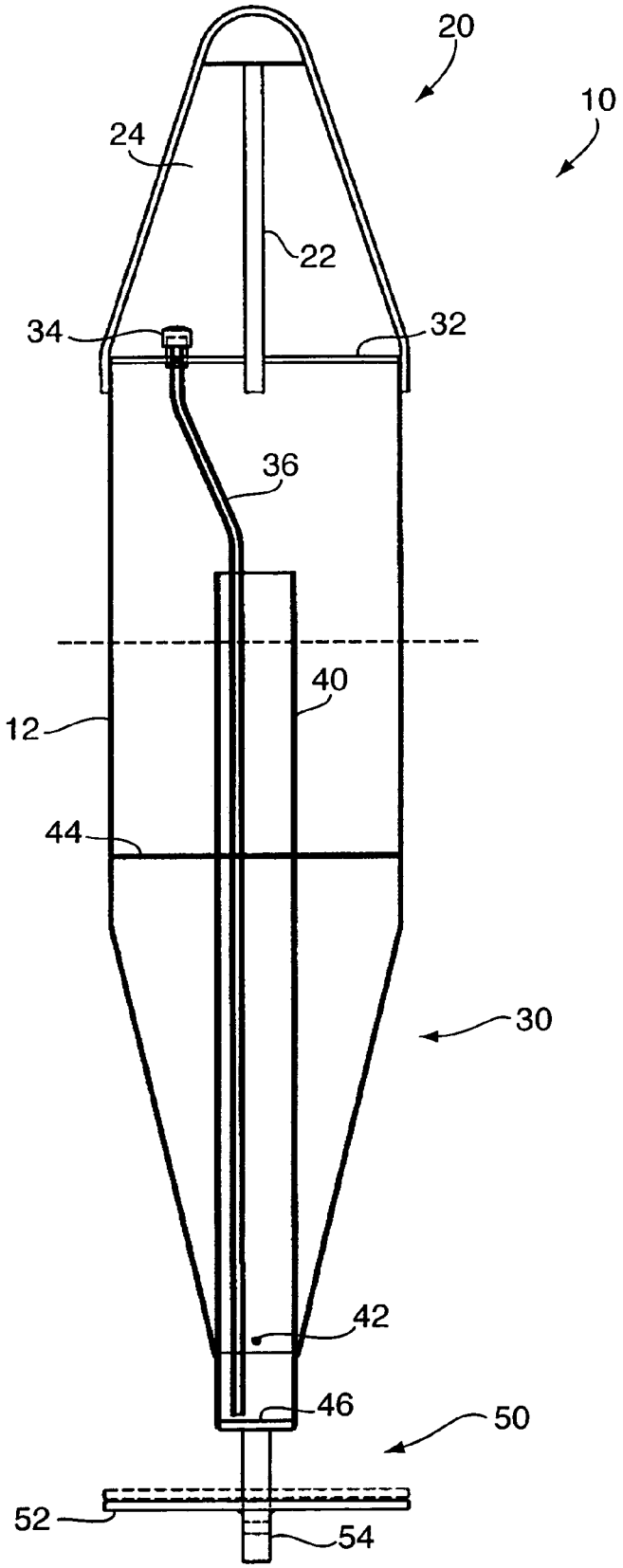
FIG. 1 shows a cross-sectional view of a buoy according to a preferred embodiment of the present invention.

Turning to FIG. 1, the structure of a marine buoy according to an embodiment of the present invention is described. Although a "nun"-type navigational buoy is depicted in FIG. 1, it will be readily understood by those skilled in the art that the invention is equally applicable to other types of navigational buoys. A buoy 10 is provided with a cap 20 with radar-reflective stiffening-flanges 22 and 24, a ballasting compartment 30, and a mooring/stabilization component 50. The use herein of terms indicative of an orientation, like top, bottom, upper, lower, side, and underneath, are to be understood relative to the normal waterborne orientation of the buoy 10.

A body 12 of the buoy 10 is preferably constructed from a lightweight or light gauge material, relative to conventional heavy gauge carbon steel buoys. Materials such as aluminum, light-gauge stainless or carbon steel, or non-metallic materials can be selected. The use of lighter-weight materials can result in a weight reduction of up to 65% for a given size of buoy. Material selection is at least partially driven by cost and operational constraints. Operational constraints, including suitable protective coatings, may include factors like environmental conditions at a deployed location, traffic density and likelihood of collision, and size/visibility requirements.

The ballasting compartment 30 is sized to accommodate sufficient liquid ballast for the desired stability characteristic, given the size and design of the buoy 10 while deployed. In high-corrosion environments (e.g., saltwater), corrosion-resistant coatings can be applied. If the buoy 10 will be subjected to freezing conditions, an anti-freeze agent can be added to the liquid water ballast.

The liquid ballast can be added-to or removed from the ballasting compartment by a liquid-ballasting/-venting pipe 36. Liquid ballast is externally supplied to or removed through connection 34 at the upper end of the liquid-ballasting/-venting pipe 36 extending through the upper wall 32. The liquid-ballasting/-venting pipe 36 extends substantially to the bottom of the ballasting compartment 30 inside of an inner cylindrical wall 40. Liquid ballast supplied to or removed from connection 34 enters or leaves the ballasting compartment 30 from the lower end of the liquid-ballasting/-venting pipe 36. One-inch diameter communication hole(s) 42 formed in the cylindrical wall 40 convey liquid ballast to or from compartment 30 to pass through the cylindrical wall 40. Baffle plate 44 reduces any free surface movement of the liquid ballast during pitching and rolling of the buoy 10.

Ballast plate 44 is immersed a few inches below the surface of the liquid ballast. Baffle plate 44 is welded to cylindrical wall 40, but is loosely fitted and not sealed to the internal wall of body 12.

A square plate 52 is bolted, or otherwise fastened, to the lower wall 46 of body 12. The weight and hydrodynamics of the plate 52 help maintain the proper orientation of the buoy 10 when deployed. The square plate 52 has a width equal to the widest diameter of buoy 10, which allows the buoy 10 to be stably placed on its side on a flat surface, such as the deck of a ship.

A distal end 54 is adapted to receive a high-strength, flexible tether (not shown). Preferably a high-strength, flexible, elastic tether can be employed. A high-strength, flexible, elastic tether allows the buoy 10 to be securely moored in a given water depth using a shorter scope than would be required for a traditional heavy mooring chain. More accurate positioning of the buoy is thereby made possible.

From the foregoing, it can be seen that the present invention provides a buoy that is lightweight yet still enjoys the stability of a conventional, much heavier buoy when deployed.

In a retrieval operation, a retrieval vessel comes alongside the buoy 10, usually attaching a line to the buoy to ensure the appropriate relative positioning of vessel and buoy during retrieval operations. The retrieval vessel accesses connection 34 and attaches a de-ballasting means, typically a pump or the like, to connection 34. The liquid ballast is then removed from the ballasting compartment 30. The significantly lightened buoy is then lifted from the water, using a crane or davit. The buoy 10 is stored on its side such that the square plate 52 inhibits rolling.

Once the required maintenance has been performed, or whenever deployment is required, the buoy 10 is re-attached to the tether (if detached) lowered into the water, by a crane or davit. A ballasting means, preferably the same as the de-ballasting means (e.g. a pump or the like), is attached to replace the liquid ballast.

Those skilled in the art will appreciate that the present invention is not limited to the embodiments described, but that various modifications and alterations can be made without departing from the scope of the present invention.

What is claimed is:

1. A navigation buoy comprising:

a cylindrical body of lighter construction having an interior and an exterior;

a ballasting chamber in a lower portion of said body interior, adapted to store a liquid ballast, said ballasting chamber having a circumference, the ballasting chamber including an inner cylindrical wall, said inner cylindrical wall having a circumference smaller than said ballasting chamber circumference, said inner cylindrical wall having an aperture open to said ballasting chamber; and a connection used to ballast and vent said ballasting chamber allowing liquid communication between the ballasting chamber bottom and the body exterior, said connection being within said inner cylindrical wall;

whereby the buoy can be ballasted and de-ballasted by a liquid supplied to and removed from the ballasting chamber so as to duplicate the dampened motion of the conventional heavily constructed buoys when deployed, said liquid being supplied to the connection within said inner cylindrical wall and into the ballasting chamber through said aperture.

2. The navigation buoy of claim 1, wherein the ballasting chamber includes an internal baffling system to minimize free-surface effect of a liquid contained within the ballasting the chamber, said baffling system including a horizontal baffle secured to said inner cylindrical wall, said horizontal baffle allowing liquid to pass beyond the baffle to an upper portion of the ballasting chamber;

whereby waterborne stability of the buoy is improved.

3. The navigation buoy of claim 2, wherein the internal baffling system is a horizontal baffle located approximately 2-inches below the surface of said liquid ballast.

4. The navigation buoy of claim 1, further comprising:

a bottom plate having a flat edge, the bottom plate being directly attached to the exterior of said buoy body at a lower end of the body such that the bottom plate is wide enough to provide a roll-resistant surface when the buoy is stored prior to launching and deployment.

5. The navigation buoy of claim 1, further comprising:

a high-strength, flexible, elastic tether attached below a lower end of the body and adapted to securely connect the navigation buoy to an anchor;

whereby the high-strength, flexible, elastic tether provides a means of anchoring the buoy permitting a shorter scope than required by a conventional anchor chain whereby the accuracy of the buoy's position is improved.

6. A method for handling a waterborne liquid-ballasted buoy, the method comprising the steps of:

attaching a liquid-ballasting/-venting system to the buoy, said system having a liquid ballasting connection above the waterline from which the buoy is to be removed, said connection allowing removal of liquid ballast from an interior portion of said buoy including an interior portion of the buoy that is below said waterline;

removing liquid ballast from the buoy via the ballasting/venting system;

lifting the buoy out of the water;

whereby lifting the buoy from the water is facilitated by removing the liquid ballast.

7. The method of claim 6, further comprising the step of:

stably storing the buoy on a side corresponding to a flat edge of a bottom plate attached underneath the buoy;

whereby the flat edge of the bottom plate inhibits the buoy from rolling when stored on a flat surface.

8. The method of claim 6, further comprising the step of:

lowering the buoy into the water;

attaching a liquid-ballasting/-venting system to the buoy;

adding liquid ballast to the buoy via the ballasting/venting system;

deploying the liquid-ballasted buoy;

whereby the waterborne stability of the deployed liquid-ballasted buoy is enhanced by the addition of the liquid ballast.

* * * * *